US009274488B2

(12) United States Patent
Hayami

(10) Patent No.: US 9,274,488 B2
(45) Date of Patent: Mar. 1, 2016

(54) IMAGE FORMING APPARATUS THAT IMPARTS AN ELECTRICAL CHARGE TO A RECORDING MEDIUM

(71) Applicant: Konica Minolta, Inc., Tokyo (JP)

(72) Inventor: Toshiki Hayami, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/539,156

(22) Filed: Nov. 12, 2014

(65) Prior Publication Data

US 2015/0160589 A1 Jun. 11, 2015

(30) Foreign Application Priority Data

Dec. 5, 2013 (JP) ..... 2013-252332

(51) Int. Cl.
*G03G 15/00* (2006.01)
*G03G 15/16* (2006.01)

(52) U.S. Cl.
CPC ..... *G03G 15/6594* (2013.01); *G03G 15/1695* (2013.01); *G03G 2215/00476* (2013.01); *G03G 2215/00481* (2013.01); *G03G 2215/00654* (2013.01); *G03G 2215/0125* (2013.01); *G03G 2215/1666* (2013.01)

(58) Field of Classification Search
CPC ..... G03G 15/1695; G03G 15/6594; G03G 2215/1666; G03G 2215/00654; G03G 2215/00476; G03G 2215/00481
See application file for complete search history.

(56) References Cited

U.S. PATENT DOCUMENTS 5,923,943 A * 7/1999 Ahn ..... G03G 15/1695 399/388
6,128,463 A * 10/2000 Matsumoto ..... G03G 15/231 399/364
6,253,037 B1 * 6/2001 Park ..... G03G 15/1695 399/44
7,917,079 B2 3/2011 Yoshioka

FOREIGN PATENT DOCUMENTS

JP 2006-267486 A 10/2006
JP 2008-262085 A 10/2008

* cited by examiner

*Primary Examiner* — Blake A Tankersley
(74) *Attorney, Agent, or Firm* — Lucas & Mercanti, LLP

(57) ABSTRACT

An image forming apparatus includes: an image forming unit which forms a toner image on an image carrier; a conveying unit which conveys a recording medium; a transfer unit which transfers the toner image formed on the image carrier to the recording medium conveyed by the conveying unit in a transfer nip; a pre-transfer charging unit which imparts an electrical charge, having a polarity opposite to a normal charge polarity of a toner, to the recording medium conveyed by the conveying unit on an upstream side of the transfer nip in a conveyance direction; and a destaticizing unit which removes a part of the electrical charge that is imparted to a surface of the recording medium by the pre-transfer charging unit and corresponds to unevenness on the surface of the recording medium on an upstream side of the transfer nip in the conveyance direction.

10 Claims, 6 Drawing Sheets

IMAGE FORMING APPARATUS THAT IMPARTS AN ELECTRICAL CHARGE TO A RECORDING MEDIUM

The entire disclosure of Japanese Patent Application No. 2013-252332 filed on Dec. 5, 2013 including description, claims, drawings, and abstract are incorporated herein by reference in its entirety.

BACKGROUND OF THE INVENTION

1. Field of the Invention

The present invention relates to an electrophotographic image forming apparatus, particularly to an image forming apparatus which forms a toner image on a sheet of paper such as embossed paper having an uneven surface.

2. Description of the Related Art

An image forming apparatus such as an electrophotographic printer or copier forms a toner image on an image carrier such as a photoreceptor, transfers the formed toner image onto a sheet of paper, and then performs heating/pressure fixing to obtain the sheet of paper on which the toner image is formed.

As the range of uses of the copier and printer has been increasing in recent years, paper with various paper qualities including embossed paper, the surface of which is embossed, has come into use in addition to plain paper having a smooth surface.

A problem with the paper having a highly uneven surface such as the embossed paper is that a toner is not sufficiently transferred to a concave portion of the paper, resulting in decreased uniformity of an image.

An image forming apparatus disclosed in JP 2006-267486 A and JP 2008-185890 A realizes improved uniformity in a post-transfer image by imparting an electrical charge that has an opposite polarity to that of the toner to a transfer surface of the embossed paper with use of a pre-transfer charge roll.

JP 2008-262085 A discloses an image forming apparatus which imparts in advance an electrical charge having the same polarity as that of the toner to a convex portion of the embossed paper with use of a pre-transfer electrical charge imparting unit such as an electrode. As a result, a transfer electric field relatively stronger in the concave portion than in the convex portion can be created in a secondary transfer nip, so that the uniformity in the post-transfer image is improved across the paper surface by setting an optimized secondary transfer bias to the concave portion.

With the technology disclosed in JP 2006-267486 A and JP 2008-185890 A, however, the toner is not well transferred to the concave portion of the embossed paper when the amount of electrical charge imparted to the embossed paper by the charge roll is insufficient, in which case the image has imperfect uniformity. When the excessive amount of electrical charge is imparted to the embossed paper, on the other hand, one can expect the toner to be better transferred to the concave portion whereas in the convex portion, the excessive amount of electrical charge causes local electrical discharge to the toner and thus causes new defective transfer such as so-called transfer cissing and scattering.

Moreover, the technology disclosed in JP 2008-262085 A imparts an electrical charge that cancels the transfer electric field to the convex portion of the paper, thereby making it less prone to result in the defective transfer accompanying the electrical discharge to the toner in the convex portion. This technology improves transfer performance to the concave portion by increasing the secondary transfer bias. However, there is a limitation to how much the transfer performance is improved by increasing the secondary transfer bias in the case of the paper having the highly uneven surface such as the embossed paper because the defective transfer caused by the electrical discharge to the toner occurs before the transfer performance to the concave portion is sufficiently improved, where the transfer performance to the concave portion and the defective transfer caused by the electrical discharge cannot be improved at the same time.

SUMMARY OF THE INVENTION

The present invention has been made in consideration of the aforementioned circumstances, and an object of the present invention is to provide an image forming apparatus which can improve both the transfer performance to the concave portion and the defective transfer caused by the electrical discharge in the convex portion when the uneven paper such as the embossed paper is used.

To achieve at least one of the above-mentioned objects, according to an aspect, an image forming apparatus reflecting one aspect of the present invention comprises: an image forming unit which forms a toner image on an image carrier; a conveying unit which conveys a recording medium; a transfer unit which transfers the toner image formed on the image carrier to the recording medium conveyed by the conveying unit in a transfer nip; a pre-transfer charging unit which imparts an electrical charge, having a polarity opposite to a normal charge polarity of a toner, to the recording medium conveyed by the conveying unit on an upstream side of the transfer nip in a conveyance direction; and a destaticizing unit which removes a part of the electrical charge that is imparted to a surface of the recording medium by the pre-transfer charging unit and corresponds to unevenness on the surface of the recording medium on an upstream side of the transfer nip in the conveyance direction.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 5A illustrates a state of a sheet of paper in a transfer nip in the related art, and FIG. 5B illustrates a state of the sheet of paper right after passing through the transfer nip;

FIG. 6A illustrates a state of the sheet of paper right after passing through a nip of a pre-transfer charging unit, FIG. 6B illustrates a state of the sheet of paper right after passing through a nip of a pre-transfer destaticizing unit, FIG. 6C illustrates a state of the sheet of paper in the transfer nip, and FIG. 6D illustrates a state of the sheet of paper right after passing through the transfer nip;

DESCRIPTION OF THE PREFERRED EMBODIMENTS

Figure 1:
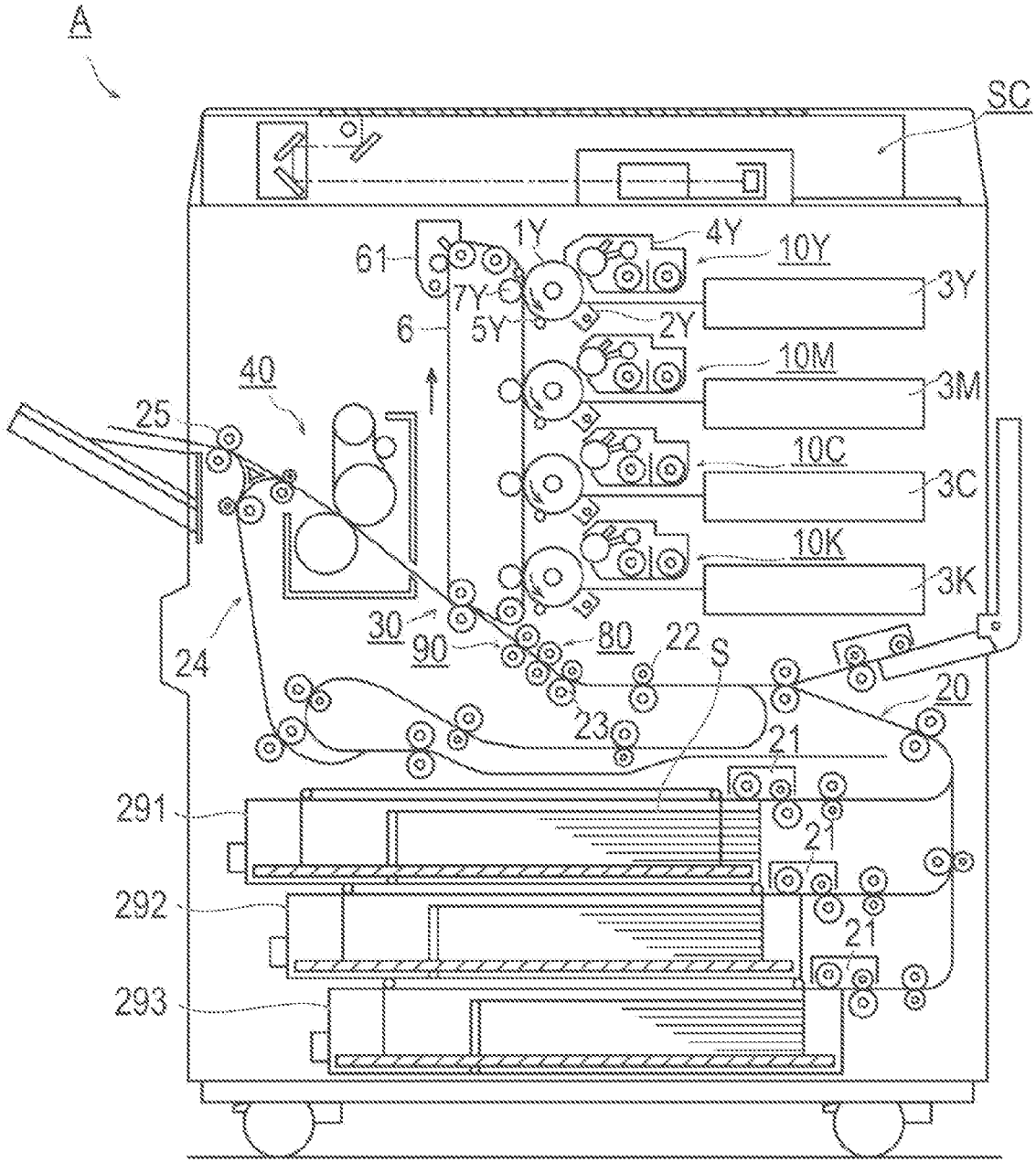
FIG. 1 is a diagram illustrating a whole image forming apparatus.

Hereinafter, embodiments of the present invention will be described with reference to the drawings. However, the scope of the invention is not limited to the illustrated examples.

Note that the same reference numeral is assigned to the same element in the drawings and the present specification to omit redundant description. Moreover, the dimension ratio in the drawings is exaggerated for the convenience of explanation and may be different from the actual ratio.

(Image Forming Apparatus)

Figure 2:
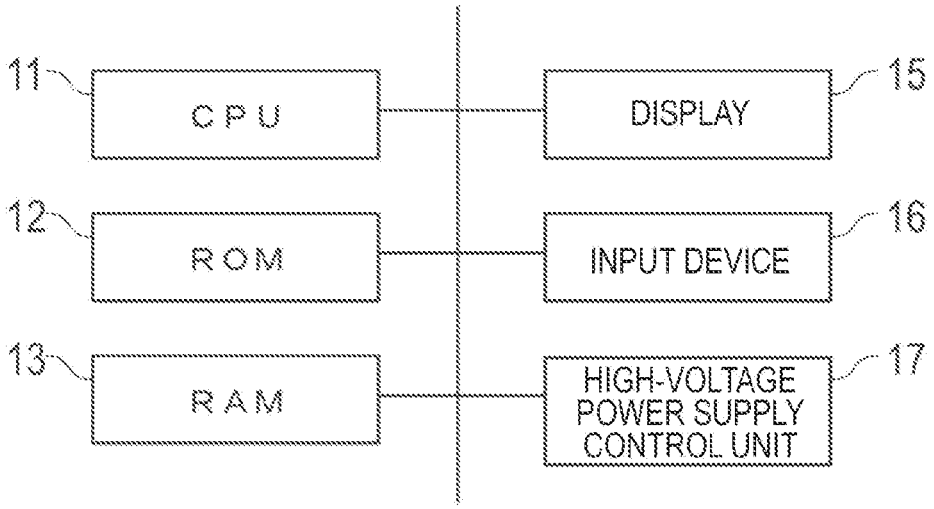
FIG. 2 is a control block diagram of the image forming apparatus.

An image forming apparatus according to the present embodiment will be described with reference to FIGS. 1 and 2. FIG. 1 is a diagram illustrating a whole image forming apparatus A, and FIG. 2 is a block diagram of the image forming apparatus A.

The image forming apparatus A is what is referred to as a tandem color image forming apparatus and includes a plurality of image forming units 10Y, 10M, 10C, and 10K, a belt-like intermediate transfer belt 6, a paper feeding device 20, and a fixing device 30.

A scanner SC is installed in an upper part of the image forming apparatus A. An image of an original placed on an original platen is scan exposed by an optical system of an original image scanning exposure device of the scanner SC and read by a line image sensor. An analog signal undergone photoelectric conversion by the line image sensor is then subjected to analog processing, A/D conversion, shading correction, and image compression processing in a control unit to be input to exposure units 3Y, 3M, 3C and 3K.

Note that in the present specification, a general name of a component is indicated by a reference numeral from which an alphabetical subscript is omitted, whereas an individual component is indicated by a reference numeral to which each of Y (yellow), M (magenta), C (cyan), and K (black) is added as the subscript.

Each of the image forming unit 10Y forming a yellow (Y) image, the image forming unit 10M forming a magenta (M) image, the image forming unit 10C forming a cyan (C) image, and the image forming unit 10K forming a black (K) image includes a charge pole 2, the exposure unit 3, a developing device 4, and a cleaning unit 5 that are disposed around a drum-like photoreceptor 1 as an image carrier (reference numerals for M, C, and K are omitted in some parts).

The photoreceptor 1 is formed of an organic photoreceptor which is formed by forming a photosensitive layer made of resin containing an organic photoconductor around an outer peripheral surface of a drum-like metal base, for example, and is arranged while extending in a width direction of a sheet of paper S being conveyed (a direction perpendicular to a paper surface in FIG. 1 and hereinafter also referred to as an "axial direction"). The resin forming the photosensitive layer can be polycarbonate, for example.

The developing device 4 includes a two-component developer formed of a toner and a carrier that are small particulates in each of yellow (Y), magenta (M), cyan (C), and black (K). The two-component developer is formed of the carrier which has ferrite as a core and an insulating resin coated therearound, and the toner having polyester as a main material to which a colorant such as a pigment or carbon black, a charge control agent, silica, and titanium oxide are added. The carrier has a particle diameter of 10 to 50 μm and saturation magnetization of 10 to 80 emu/g, while the toner has a particle diameter of 4 to 10 μm, a negative charge characteristic, and an average charge amount of −20 to −60 μC/g. These carrier and toner are mixed such that the toner concentration equals 4 to 10 mass % to be used as the two-component developer.

The belt-like intermediate transfer belt 6 is rotatably supported by a plurality of rollers. The intermediate transfer belt 6 is a seamless belt with the volume resistivity of 6 to 12 LOG Ω·cm, and can be a semiconductive seamless belt having the thickness of 0.04 to 0.10 mm and formed by dispersing a conductive material in an engineering plastic such as a modified polyimide, a thermosetting polyimide, an ethylene-tetrafluoroethylene copolymer, a polyvinylidene fluoride, and a nylon alloy, for example.

A toner image in each color formed on the photoreceptor 1 by each of the image forming units 10Y, 10M, 10C, and 10K is transferred one by one onto the rotating intermediate transfer belt 6 by a primary transfer roller 7 (primary transfer), whereby a composed color image is formed. On the other hand, a residual toner on the photoreceptors 1Y, 1M, 1C, and 1K after performing the image transfer is removed by a brush roller of the cleaning unit 5 of each color.

The paper feeding device 20 includes paper storage units 291, 292, and 293, a first paper feeding unit 21, a paper feeding roller 22, and a resist roller 23. The resist roller 23 is connected to a clutch and a motor that are not shown, and performs stop and rotation control to convey the sheet of paper S to a transfer nip Nt in synchronization with a timing at which the toner image formed on the intermediate transfer belt 6 reaches the transfer nip Nt.

The paper storage units 291, 292, and 293 can store a plurality of sheets of paper S, which is fed by the first paper feeding unit 21 and conveyed by the paper feeding roller 22 and the resist roller 23 to a secondary transfer unit 30 disposed downstream in the conveyance direction.

The conveyed paper is conveyed to the secondary transfer unit 30 through a pre-transfer charging unit 80 and a pre-transfer destaticizing unit 90, where the color image formed on the intermediate transfer belt 6 is transferred to the sheet of paper S in the transfer nip Nt of the secondary transfer unit 30 (secondary transfer).

The fixing device 40 applies heat and pressure to the sheet of paper S to which the color image is transferred, whereby a color toner image (or a toner image) is fixed to the sheet of paper S. The sheet of paper is thereafter discharged through a paper discharge roller 25 provided in a paper discharge path and placed on a paper discharge tray outside the machine.

After transferring the color image to the sheet of paper S by the secondary transfer unit 30, on the other hand, a residual toner on the intermediate transfer belt 6 having self-stripped the sheet of paper S is removed by a belt cleaning unit 61.

When the image is to be copied on both sides of the sheet of paper S, the sheet of paper S is branched off from the paper discharge path by a branch board after fixing the image formed on a first side of the sheet of paper S, and is then introduced to a both-side path 24 and reversed to be conveyed again through the paper feeding roller 22 and the like. The toner image formed on the intermediate transfer belt 6 is transferred to a second side of the sheet of paper S by the image forming units 10Y, 10M, 10C, and 10K, and the fixing device 40 performs heating/fixing processing on the sheet of paper, which is thereafter discharged outside the apparatus by the paper discharge roller 25.

FIG. 2 is a control block diagram of the image forming apparatus A. Note that the figure mainly includes a principal part needed in describing the operation of the present embodiment and that other known parts of the image forming apparatus are omitted.

A CPU 11 functions as a control unit which executes various controls on the image forming apparatus A according to a program. A ROM 12 stores a program and data used to perform various controls. A RAM 13 is used as a work area of the CPU 11 and temporarily stores a program and data required for the CPU 11 to control the image forming apparatus A. The CPU 11 then controls the image forming apparatus A on the basis of the program and data extracted in the RAM 13. A display 15 displays various information on a liquid crystal screen of the display. An input device 16 is a touch sensor superposed on the display 15, a keyboard, or a mouse which acquires an instruction from a user. The user in the present embodiment can input information on the paper stored in the paper storage units 291, 292, and 293 by using the display 15 and the input device 16. The user can input, as the information on the paper, a piece of information on the thickness of the paper such as thick paper, thin paper or weight as well as a piece of information on special paper such as coated paper, the embossed paper, or rough paper.

A high-voltage power supply control unit 17 controls high-voltage power supplies 300, 800, and 900 (refer to FIG. 3) which supply power to the secondary transfer unit 30, the pre-transfer charging unit 80, and the pre-transfer destaticizing unit 90, respectively.

When the paper storage unit which is set to store highly uneven paper such as the embossed paper is selected to execute an image forming job, the control unit controls the high-voltage power supply control unit 17 to output voltage not only to the secondary transfer unit 30 but to the pre-transfer charging unit 80 and the pre-transfer destaticizing unit 90.

<First Embodiment>

Figure 3:
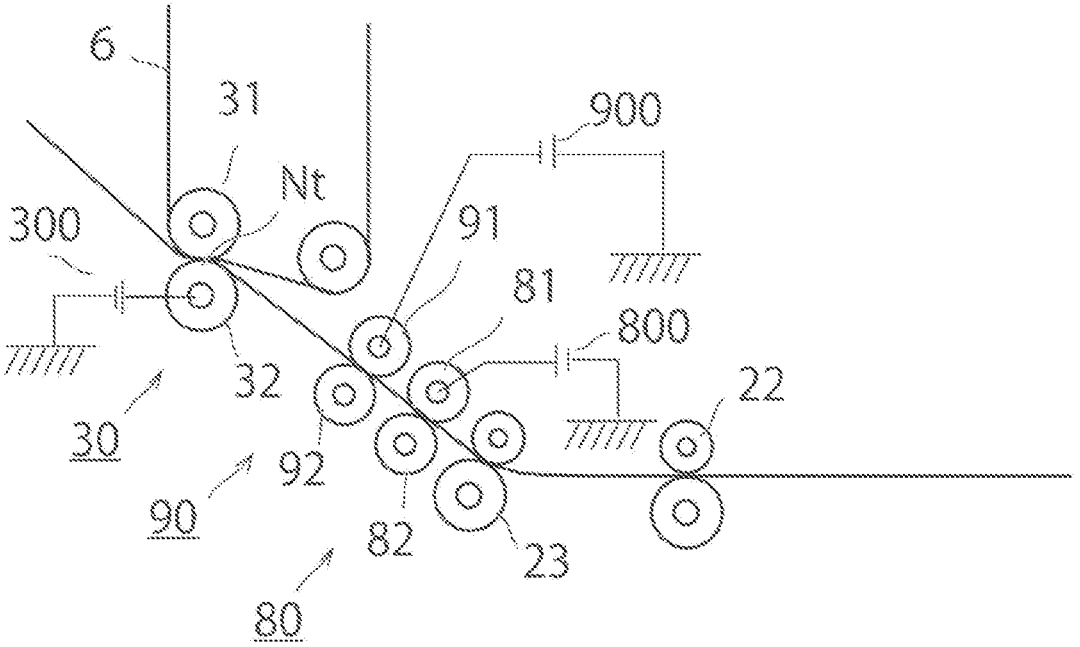
FIG. 3 is an enlarged view illustrating the periphery of a secondary transfer unit.
Figure 4:
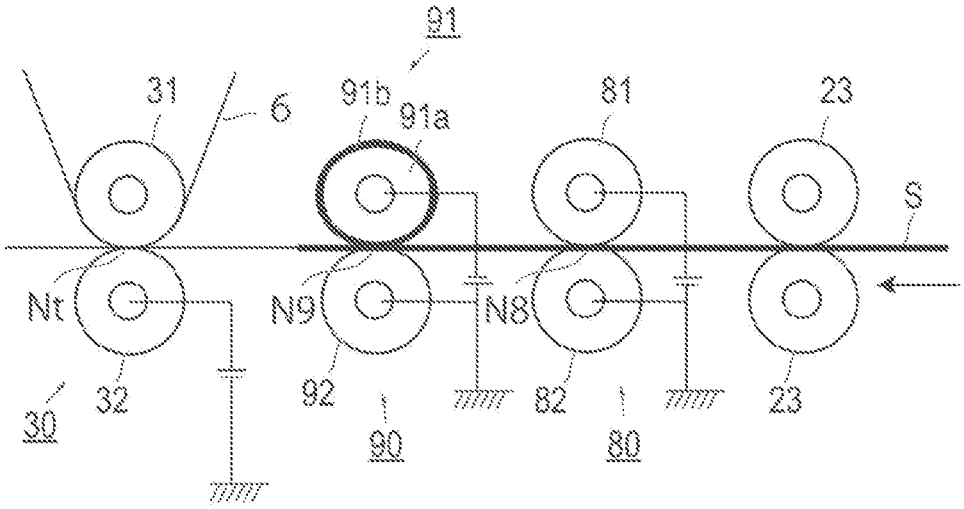
FIG. 4 is a diagram schematically illustrating a configuration of what is illustrated in FIG. 3.

FIG. 3 is an enlarged view illustrating the periphery of the secondary transfer unit 30, and FIG. 4 is a diagram schematically illustrating the configuration illustrated in FIG. 3.

In the present embodiment, as illustrated in FIGS. 3 and 4, the pre-transfer charging unit 80 is provided between the resist roller 23 being the conveying unit on the most downstream side of the paper feeding device 20 and the secondary transfer unit 30, and the pre-transfer destaticizing unit 90 is provided between the pre-transfer charging unit 80 and the secondary transfer unit 30.

The secondary transfer unit 30 includes a counter roller 31 disposed on an inner peripheral surface side of the intermediate transfer belt 6 and a secondary transfer roller 32, where the high-voltage power supply 300 supplies to the secondary transfer roller 32 a voltage to form a transfer electric field between the secondary transfer roller 32 and the counter roller 31.

The intermediate transfer belt 6 is formed of a polyimide semiconductor belt which is made of a polyimide material, has the resistivity set to 11.0 LOG Ω/□, and has the thickness of 80 μm.

Both the counter roller 31 and the secondary transfer roller 32 are rollers made of an NBR (Nitrile Butadiene Rubber) with the rubber hardness of 71° (Asker-C) and the resistance value of 7.5 LOG Ω in a ϕ38-mm straight form.

Moreover, at least one of the counter roller 31 and the secondary transfer roller 32 is energized toward the other roller with the pressing force of 80 N while interposing the intermediate transfer belt 6 between the rollers. Note that the transfer nip Nt formed by the two rollers is 340 mm in length in the axial direction. (Pre-transfer charging unit)

The pre-transfer charging unit 80 includes an upper charge roller 81 and a lower charge roller 82.

The upper charge roller 81 is a roller made of a foam NBR with the rubber hardness of 45° (Asker-C), the diameter of ϕ38 mm, and the resistance value of 6.5 LOG Ω. The secondary transfer roller 32 is diverted to the lower charge roller 82 where the dimension, material, and physical property thereof are identical to that of the secondary transfer roller 32.

Moreover, at least one of the upper charge roller 81 and the lower charge roller 82 is energized toward the other roller with the pressing force of 80 N. Note that a nip N8 formed by the two rollers is 340 mm in length in the axial direction.

The high-voltage power supply 800 applies voltage having a polarity opposite to a normal charge polarity (negative polarity) of the toner to the upper charge roller 81. The applied voltage is preferably about +2.0 to +5.0 KV but is set to +2.0 KV in the present embodiment. The upper charge roller 81 is thus brought into contact with a surface (an upper surface in FIG. 4), on which the toner image is formed, of the sheet of paper S conveyed from the resist roller 23. As a result, an electrical charge with the polarity opposite to the normal charge polarity of the toner is imparted to the surface of the sheet of paper S being conveyed.

(Pre-Transfer Destaticizing Unit)

The pre-transfer destaticizing unit 90 includes an upper destaticizing roller 91 and a lower destaticizing roller 92. The upper destaticizing roller 91 is formed of an inner roller 91*a* and an outer layer 91*b* outside the inner roller. The counter roller 31 is diverted to the inner roller 91*a* where the dimension, material, and physical property thereof are identical to that of the counter roller 31. The intermediate transfer belt 6 is diverted to the outer layer 91*b* covering the inner roller 91*a*, where the material and the physical property such as the thickness and the surface resistivity of the outer layer are identical to that of the intermediate transfer belt 6. The secondary transfer roller 32 is diverted to the lower destaticizing roller 92 where the dimension and material thereof are identical to that of the secondary transfer roller 32.

Moreover, at least one of the upper destaticizing roller 91 and the lower destaticizing roller 92 is energized toward the other roller with the pressing force of 80 N. Note that a nip N9 formed by the two rollers is 340 mm in length in the axial direction.

The high-voltage power supply 900 applies voltage of −3.5 KV with a polarity (polarity opposite to that of the voltage applied to the pre-transfer charging unit 80) same as the normal charge polarity of the toner to the upper destaticizing roller 91. The upper destaticizing roller 91 is thus brought into contact with a surface (an upper surface in FIG. 4) of the sheet of paper S, to which the electrical charge is imparted by the pre-transfer charging unit 80, and removes the electrical charge on the surface.

Comparing the pre-transfer charging unit 80 and the pre-transfer destaticizing unit 90, the pressing force in both of the nips N8 and N9 in the pre-transfer charging unit 80 and the pre-transfer destaticizing unit 90 is set to 80 N, but the upper roller (upper charge roller 81) of the pre-transfer charging unit 80 has lower hardness than the upper roller (upper destaticizing roller 91) of the pre-transfer destaticizing unit 90. This means that the upper charge roller 81 is crushed further than the upper destaticizing roller 91.

As a result of such setting, the charging performance of the pre-transfer charging unit 80 is superior to the destaticizing performance of the pre-transfer destaticizing unit 90 against the conveyed sheet of paper S.

More specifically, the upper charge roller 81 can come into contact or slight contact with a deeper point in the concave portion of the sheet of paper S having the uneven surface such as the embossed paper than the upper destaticizing roller 91 can. As a result, the pre-transfer charging unit 80 can charge a deeper point in the concave portion on the surface of the sheet of paper S conveyed through the nip N8, whereas the pre-transfer destaticizing unit 90 can only destaticize down to a shallow area in the concave portion on the surface of the sheet of paper S conveyed through the nip N9 which is disposed on the downstream side of the nip N8. In other words, the pre-transfer destaticizing unit 90 removes not all but a part of the electrical charge imparted to the surface of the sheet of paper S by the pre-transfer charging unit 80. More specifically, the pre-transfer destaticizing unit 90 can remove the electrical charge in the area other than the concave portion, particularly the deeper point in the concave portion of the sheet of paper S that does not come into contact with the pre-transfer destaticizing unit 90. A part of the electrical charge imparted by the pre-transfer charging unit 80 can thus be left on the surface of the sheet of paper S that is conveyed to the transfer nip Nt.

(Problem and Effect)

Figure 5A:
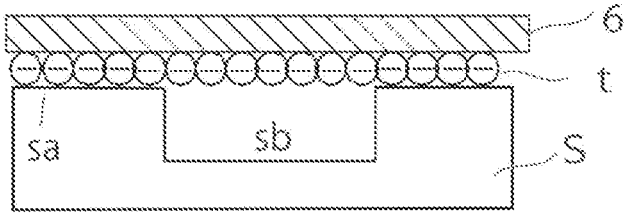
FIGS. 5A and 5B are schematic diagrams illustrating a mechanism of how defective transfer occurs on a sheet of paper having an uneven surface such as embossed paper in the related art, where
Figure 5B:
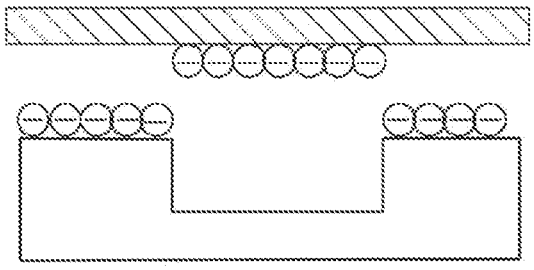

Now, the effect of leaving a part of the electrical charge imparted to the surface of the sheet of paper S according to the present embodiment will be described with reference to FIGS. 5A and 5B and 6A to 6D. FIGS. 5A and 5B are schematic diagrams illustrating a mechanism of how defective transfer occurs, in the related art, on the sheet of paper having the uneven surface such as the embossed paper, and FIGS. 6A to 6D are schematic diagrams each illustrating a state of the sheet of paper S being conveyed.

FIG. 5A illustrates a state of the sheet of paper S in the transfer nip Nt in the related art, and FIG. 5B illustrates a state of the sheet of paper S right after passing through the transfer nip Nt.

When Leathac 66 (trade name) manufactured by Tokushu Paper Mfg. Co., Ltd. is used as the embossed paper, for example, the maximum height of the unevenness on the surface of the paper is 100 to 150 μm, which is sufficiently larger than the particle diameter (4 to 10 μm) of a toner t. In the transfer nip Nt, the toner t can come into contact with a convex portion sa formed on the surface of the sheet of paper S but does not come into contact with a concave portion sb formed on the surface of the sheet of paper S, whereby a gap is created.

The toner t is satisfactorily transferred to the convex portion sa formed on the surface of the sheet of paper S that is in contact with the toner, whereas there is no pressure acting on the toner t not in contact with the concave portion sb formed on the surface of the paper, so that the toner t is transferred only by the force acting thereon by the transfer electric field formed between the intermediate transfer belt 6 and the sheet of paper S. Moreover, the transfer electric field itself is weak in the concave portion where the gap is created so that the toner t remains on the intermediate transfer belt 6 without being transferred to the concave portion sb of the sheet of paper S, thereby forming a defective image on the sheet of paper S in which an area corresponding to the concave portion appears pale and void.

Now, there will be described how the aforementioned problem is solved in the present embodiment. FIGS. 6A to 6D are diagrams each illustrating the state of the sheet of paper S passing through the nip N8 of the pre-transfer charging unit 80 and through the transfer nip Nt.

Figure 6A:
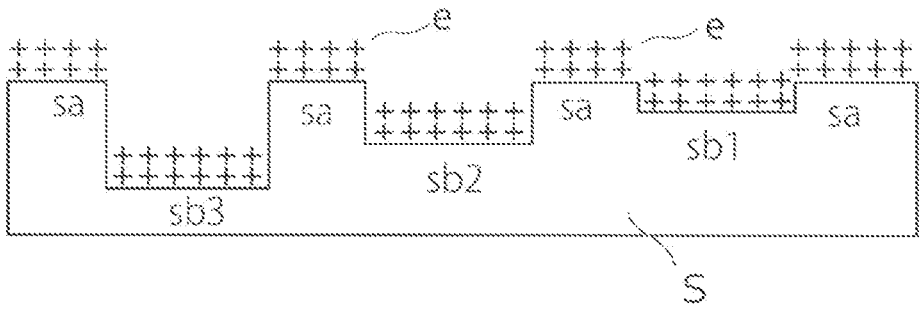
FIGS. 6A to 6D are schematic diagrams each illustrating a state of the sheet of paper being conveyed, where

FIG. 6A is a diagram illustrating a state of the sheet of paper S right after passing through the nip N8 of the pre-transfer charging unit 80. The pre-transfer charging unit 80 imparts an electrical charge e equally to the convex portion sa and to the concave portions sb (sb1 to sb3) on the surface of the sheet of paper S.

Figure 6B:
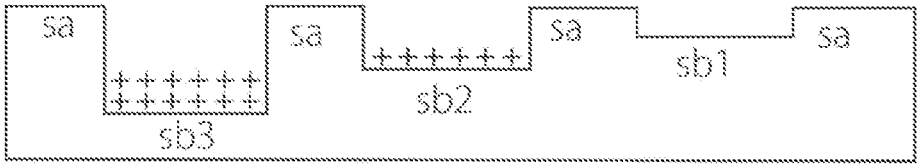

FIG. 6B following FIG. 6A illustrates a state of the sheet of paper S right after passing through the nip N9 of the pre-transfer destaticizing unit 90. One can see that a part of the electrical charge on the surface of the sheet of paper S is removed. As described above, the upper destaticizing roller 91 of the pre-transfer destaticizing unit 90 has higher hardness than the upper charge roller 81 of the pre-transfer charging unit 80, whereby the pre-transfer destaticizing unit 90 is unable to sufficiently destaticize the deeper part of the concave portion. As illustrated in FIG. 6B, the electrical charge e imparted to the convex portion sa and the shallow concave portion sb1 can be removed, whereas destaticizing is performed insufficiently on the moderately deep concave portion sb2 and is not performed on the deepest concave portion sb3, leaving a part of the electrical charge.

Figure 6C:
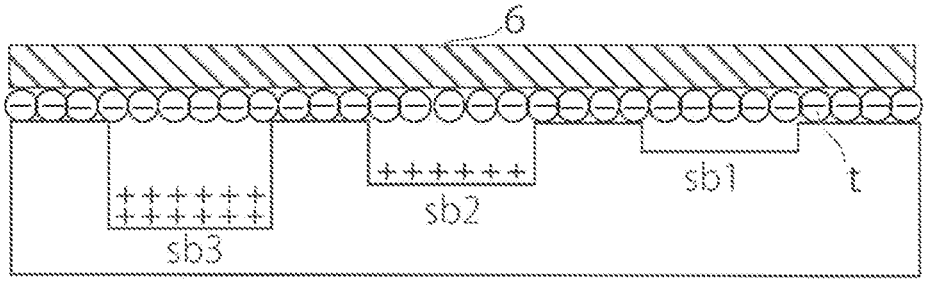
Figure 6D:
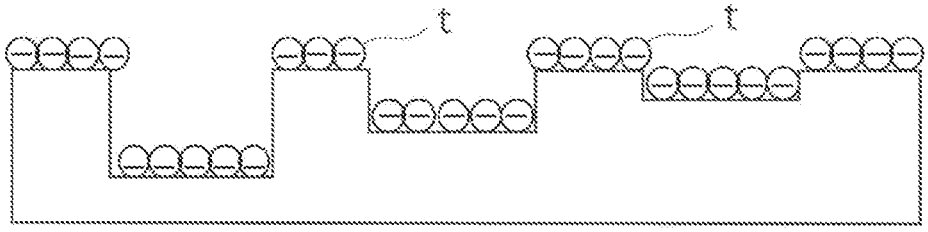

FIGS. 6C and 6D are diagrams illustrating states of the sheet of paper S in the transfer nip Nt and right after passing through the transfer nip Nt, respectively. As illustrated in FIG. 6C, the electrical charge remaining in the concave portion sb2 and the concave portion sb3 on the surface of the sheet of paper S in the transfer nip Nt allows the transfer electric field to become stronger, thereby allowing the toner to be satisfactorily transferred to the deeper concave portion of the sheet of paper S.

Moreover, a contact condition such as the material of the upper and lower rollers and the contact pressure is set similarly to a contact condition of the transfer nip Nt such that the state of contact between the rollers and the sheet of paper S in the nip N9 of the pre-transfer destaticizing unit 90 becomes roughly equal to the state of contact between the intermediate transfer belt 6 and the sheet of paper S in the transfer nip Nt. As a result, the electrical charge in the area in which the intermediate transfer belt 6 is in contact with the sheet of paper S in the transfer nip Nt can be removed selectively from the surface of the sheet of paper S.

That is, a part of the electrical charge imparted to the sheet of paper S by the pre-transfer charging unit 80 is selectively removed from the convex portion Sa and the shallow concave portion sb1 formed on the surface of the sheet of paper S, and the area from which the electrical charge is removed corresponds to the area in which the toner t on the intermediate transfer belt 6 is in contact with the surface of the sheet of paper S and is the area to which the toner can be satisfactorily transferred without the impartment of the electrical charge e by the pre-transfer charging unit 80.

There is a possibility that the defective transfer occurs in such area when any unnecessary electrical charge e is left therein, the defective transfer being caused by the effect of reverse charging of the toner t due to local discharge of electricity in the transfer nip Nt. In the present embodiment, however, the electrical charge e in the area where the intermediate transfer belt 6 or the toner on the intermediate transfer belt 6 is in direct contact with the sheet of paper S can be removed selectively. As a result, the defective transfer caused by the local discharge of electricity to the toner can be prevented while at the same time improving the transfer performance to the concave portion.

<Second Embodiment>

Figure 7:
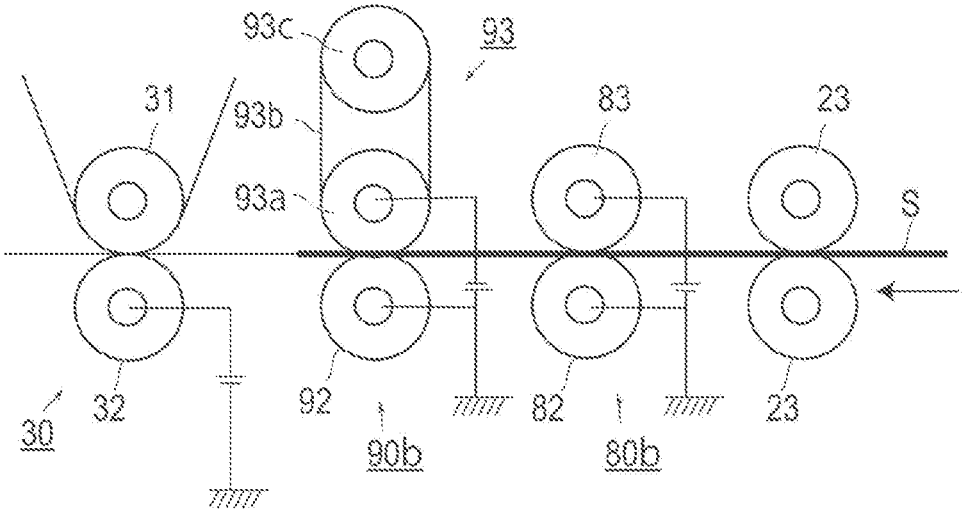
FIG. 7 is a diagram illustrating a principal part of an image forming apparatus according to a second embodiment.

FIG. 7 is a diagram illustrating a principal part of an image forming apparatus A according to second embodiment. The figure only illustrates a configuration around a secondary transfer unit 30, while the rest of the configuration is the same as that of the image forming apparatus A of the first embodiment illustrated in FIGS. 1 to 3.

(Pre-Transfer Charging Unit)

In the second embodiment, an upper charge roller 83 of a pre-transfer charging unit 80*b* is a roller made of an NBR with the rubber hardness of 71° (Asker-C), the diameter of ϕ38 mm, and the resistance value of 7.5 LOG Ω. This is identical to a counter roller 31 of a secondary transfer unit 30. As with the first embodiment, a roller identical to a secondary transfer roller 32 is used as a lower charge roller 82.

Moreover, at least one of the upper charge roller 83 and the lower charge roller 82 is energized toward the other roller with the pressing force of 110 N. Note that a nip N8 formed by the two rollers is 340 mm in length in the axial direction.

(Pre-Transfer Destaticizing Unit)

A pre-transfer destaticizing unit 90*b* includes an upper destaticizing unit 93 and a lower destaticizing roller 92. As with the first embodiment, the secondary transfer roller 32 is diverted to the lower destaticizing roller 92 where the dimension and material thereof are identical to that of the secondary transfer roller 32.

The upper destaticizing unit 93 includes a counter roller 93*a*, a seamless belt 93*b*, and a tension roller 93*c*. The counter roller 31 is diverted to the counter roller 93*a* where the dimension, material, and physical property thereof are identical to that of the counter roller 31. The seamless belt 93*b* is formed of the same base material as an intermediate transfer belt 6 and has the same material, thickness, and length in the axial direction as that of the intermediate transfer belt. The tension generated by the tension roller 93*c* is set to 45 N, which is equal to the tension of the intermediate transfer belt 6.

Moreover, at least one of the counter roller 93*a* and the lower destaticizing roller 92 is energized toward the other roller with the pressing force of 80 N. Note that a nip N9 formed by the two rollers is 340 mm in length in the axial direction.

The voltage application condition for the pre-transfer charging unit 80*b* and the pre-transfer destaticizing unit 90*b* in the second embodiment is the same as that in the first embodiment.

Unlike the first embodiment, the pressing force of the upper roller is increased instead of lowering the hardness thereof to make the charging performance of the pre-transfer charging unit 80*b* superior to the destaticizing performance of the pre-transfer destaticizing unit 90*b* in the second embodiment. Moreover, the pre-transfer destaticizing unit 90*b* employs the seamless belt made of the same material as the intermediate transfer belt 6 in order to make the contact condition in the nip N9 similar to the contact condition in a transfer nip Nt.

As a result, in the second embodiment as well, the defective transfer caused by the local discharge of electricity to a toner can be prevented while at the same time improving the transfer performance to a concave portion.

<Third Embodiment>

Figure 8:
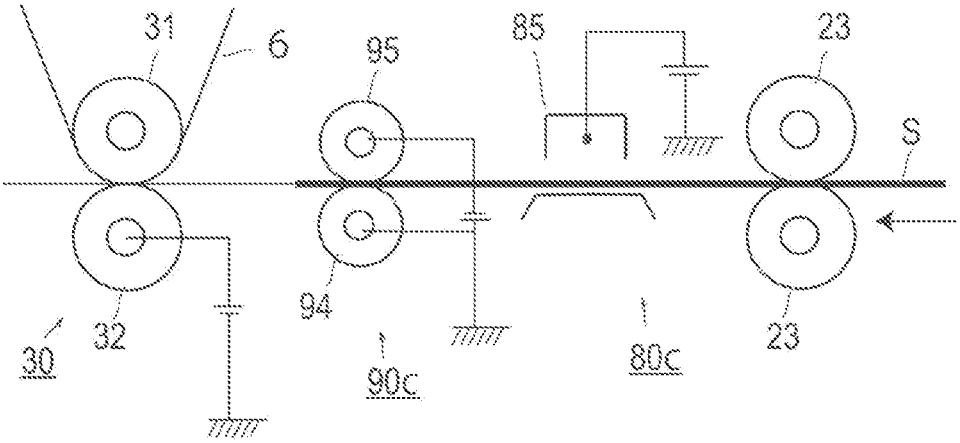
FIG. 8 is a diagram illustrating a principal part of an image forming apparatus according to a third embodiment.

FIG. 8 is a diagram illustrating a principal part of an image forming apparatus A according to third embodiment. The figure only illustrates a configuration around a secondary transfer unit 30, while the rest of the configuration is the same as that of the image forming apparatus A according to the first or second embodiment.

(Pre-Transfer Charging Unit)

In the third embodiment, a pre-transfer charging unit 80*c* employs a corotron electrode 85 instead of a charge roller. A known configuration can be applied to the corotron electrode 85, which imparts an electrical charge to a surface of a conveyed sheet of paper S by applying high voltage such as +5 KV to a discharge wire using ϕ60-μ tungsten. Note that a scorotron electrode, in which a grid is disposed between the sheet of paper S and the discharge wire, may be used instead of the corotron electrode.

(Pre-Transfer Destaticizing Unit)

An upper destaticizing roller 95 and a lower destaticizing roller 94 of a pre-transfer destaticizing unit 90*c* are identical to a counter roller 31 and a secondary transfer roller 32, respectively, and are made of an NBR with the rubber hardness of 71° (Aske-C) and the resistance value of 7.5 LOG Ω. However, the outer diameter of each of the rollers is set to ϕ24 mm, which is different from a secondary transfer unit 30.

At least one of the upper destaticizing roller and the lower destaticizing roller 94 is energized toward the other roller with the pressing force of 80 N. Note that a nip N9 formed by the two rollers is 340 mm in length in the axial direction. The voltage application condition for the pre-transfer destaticizing unit 90*c* in the third embodiment is the same as that in the first and second embodiments.

The same effect can be obtained by charging with use of the corotron electrode as the pre-transfer charging unit, as described in the present embodiment. The charging can be performed to a deeper point in a concave portion independently of the unevenness on the surface of the sheet of paper S especially with a method of charging by discharging electricity where charging is performed in a non-contact manner.

The roller of the pre-transfer destaticizing unit 90*c* differs in diameter from the roller of the secondary transfer unit but uses the same material with the same hardness and has the same pressing force as that of the roller of the secondary transfer unit, whereby the contact condition of a transfer nip Nt can be reproduced substantially. It is particularly effective to use the roller with the small diameter when the arrangement space is limited.

In the third embodiment as well, the defective transfer caused by the local discharge of electricity can be prevented while at the same time improving the transfer performance to a concave portion.

<Fourth Embodiment>

Figure 9:
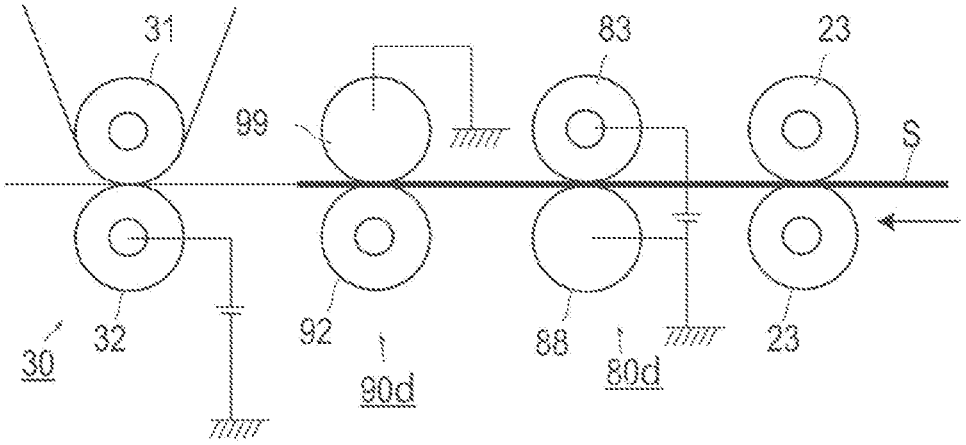
FIG. 9 is a diagram illustrating a principal part of an image forming apparatus according to a fourth embodiment.

FIG. 9 is a diagram illustrating a principal part of an image forming apparatus A according to fourth embodiment. The figure only illustrates a configuration around a secondary transfer unit 30, while the rest of the configuration is the same as that of the image forming apparatus A according to the first to third embodiments.

In the fourth embodiment, a ϕ38-mm aluminum roller is used as both a lower charge roller 88 of a pre-transfer charging unit 80*d* and an upper destaticizing roller 99 of a pre-transfer destaticizing unit 90*d*. A roller identical to that in the second embodiment is used as an upper charge roller 83 and a lower destaticizing roller 92.

The pressing force between the upper and lower rollers of each of the pre-transfer charging unit 80*d* and the pre-transfer destaticizing unit 90*d* equals 50 N, and a nip formed between the rollers is 340 mm in length in the axial direction.

As illustrated in FIG. 9, in the fourth embodiment, voltage is not applied to the upper destaticizing roller 99 of the pre-transfer destaticizing unit 90*d*, and the upper destaticizing roller is connected to GND. Note that the voltage application condition for the pre-transfer charging unit 80*d* is the same as that in the first or second embodiment.

A roller made of rubber using a low-resistance material may be used instead of the aluminum roller, as the upper destaticizing roller 99. In this case, however, it is preferred that the hardness of the upper destaticizing roller 99 is higher than the hardness of the upper charge roller 83.

In the fourth embodiment as well, the defective transfer caused by the local discharge of electricity to a toner can be prevented while at the same time improving the transfer performance to a concave portion.

Note that while the tandem image forming apparatus using the intermediate transfer belt has been illustrated in the present embodiment, the present invention may also be applied to an image forming apparatus which employs a method of directly transferring the toner image formed on the photoreceptor to a sheet of paper without using the intermediate transfer belt, such as a black-and-white image forming apparatus or an image forming apparatus which successively transfers each color image formed on a plurality of photoreceptors to the sheet of paper conveyed on a transfer belt.

According to an embodiment of the present invention, the image forming apparatus includes the configuration where the pre-transfer charging unit imparts the electrical charge to the uneven recording medium such as the embossed paper, the destaticizing unit removes a part of the imparted electrical charge corresponding to the unevenness on the surface of the recording medium, and the transfer unit thereafter transfers the toner onto the recording medium. This configuration allows both the transfer performance in the concave portion and the defective transfer caused by the electrical discharge in the convex portion to be improved when the uneven recording medium is used, whereby a high-quality image can be formed.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

an image forming unit which forms a toner image on an image carrier;

a conveying unit which conveys a recording medium;

a transfer unit which transfers the toner image formed on the image carrier to the recording medium conveyed by the conveying unit in a transfer nip;

a pre-transfer charging unit which imparts an electrical charge, having a polarity opposite to a normal charge polarity of a toner, to the recording medium conveyed by the conveying unit on an upstream side of the transfer nip in a conveyance direction; and a destaticizing unit which removes a part of the electrical charge that is imparted to a surface of the recording medium by the pre-transfer charging unit and corresponds to unevenness on the surface of the recording medium on an upstream side of the transfer nip in the conveyance direction.

2. The image forming apparatus according to claim 1, wherein the destaticizing unit removes, as the part of the electrical charge, the electrical charge imparted to an area other than a concave portion formed on the surface of the recording medium.

3. The image forming apparatus according to claim 1, wherein the destaticizing unit includes:

an upper destaticizing roller which comes into contact with a surface, on which a toner is to be transferred, of the recording medium being conveyed; and a lower destaticizing roller which forms a conveying nip together with the upper destaticizing roller, and the upper destaticizing roller removes the part of the electrical charge imparted to the surface of the recording medium and corresponding to unevenness on the surface of the recording medium being conveyed.

4. The image forming apparatus according to claim 3, wherein the pre-transfer charging unit includes:

an upper charge roller which comes into contact with the surface, on which the toner is to be transferred, of the recording medium being conveyed; and a lower charge roller which forms a conveying nip together with the upper charge roller, and hardness of the upper charge roller is lower than hardness of the upper destaticizing roller.

5. The image forming apparatus according to claim 3, wherein the pre-transfer charging unit includes:

an upper charge roller which comes into contact with the surface, on which the toner is to be transferred, of the recording medium being conveyed; and a lower charge roller which forms a conveying nip together with the upper charge roller, hardness of the upper charge roller is identical to hardness of the upper destaticizing roller, and pressing force in the conveying nip of the pre-transfer charging unit is larger than pressing force in the conveying nip of the destaticizing unit.

6. The image forming apparatus according to claim 3, wherein the image carrier is an intermediate transfer belt, the transfer unit includes a counter roller disposed on an inner peripheral surface side of the intermediate transfer belt and a secondary transfer roller which forms the transfer nip together with the counter roller, the upper destaticizing roller includes an inner roller and an outer layer covering the inner roller, and the outer layer is formed of the same material as the intermediate transfer belt.

7. The image forming apparatus according to claim 6, wherein the inner roller and the lower destaticizing roller are formed of the same material as the counter roller and the secondary transfer roller, respectively.

8. The image forming apparatus according to claim 6, wherein the inner roller and the lower destaticizing roller has the same hardness as the counter roller and the secondary transfer roller, respectively.

9. The image forming apparatus according to claim 6, wherein the pressing force between the inner roller and the lower destaticizing roller in the conveying nip of the destaticizing unit is set equal to the pressing force between the counter roller and the secondary transfer roller in the transfer nip.

10. The image forming apparatus according to claim 1, further comprising a power supply which supplies voltage having the same polarity as a normal charge polarity of a toner to the destaticizing unit.

* * * * *